United States Patent [19]

Korzekwa et al.

[11] Patent Number: 4,695,294

[45] Date of Patent: Sep. 22, 1987

[54] VIBRATORY GRINDING OF SILICON CARBIDE

[75] Inventors: Tadeusz M. Korzekwa, Lewiston; Carl H. McMurtry, Youngstown; Wolfgang D. G. Boecker, Lewiston, all of N.Y.

[73] Assignee: Stemcor Corporation, Cleveland, Ohio

[21] Appl. No.: 722,272

[22] Filed: Apr. 11, 1985

[51] Int. Cl.[4] ..... B24D 3/02

[52] U.S. Cl. ..... 51/307; 51/293; 51/308

[58] Field of Search ..... 51/308, 307, 293

[56] References Cited

U.S. PATENT DOCUMENTS

| | | | |
|---|---|---|---|
| 3,100,088 | 8/1963 | Podmore et al. | 241/170 |
| 3,268,177 | 8/1966 | McKibben | 241/175 |
| 3,615,301 | 10/1971 | Pike | 51/307 |
| 3,954,483 | 5/1976 | Prochazka | 106/44 |
| 3,966,855 | 6/1976 | Hollenberg et al. | 264/65 |
| 4,117,096 | 9/1978 | Hosaka et al. | 106/44 |
| 4,123,286 | 10/1978 | Coppola et al. | 106/44 |
| 4,275,026 | 6/1981 | Hazel et al. | 264/67 |
| 4,544,376 | 10/1985 | Duran | 51/307 |

FOREIGN PATENT DOCUMENTS 2737521 5/1979 Fed. Rep. of Germany .

OTHER PUBLICATIONS

GM 78 1A 4/78 Sweco, Inc. Bulletin.

Sweco Vibro-Energy Mill Bulletin, By Southwestern Engineering Company, date unknown.

*Primary Examiner*—Paul Lieberman

*Assistant Examiner*—Willie J. Thompson

*Attorney, Agent, or Firm*—Michael L. Dunn

[57] ABSTRACT

A method for reducing the particle size of an initial silicon carbide powder to a milled powder having an average particle size of below 1 micron but greater than an average of about 0.2 micron, without grinding media contamination. The method comprises milling the larger particles in a vibratory mill in the presence of sintered silicon carbide media comprising silicon carbide pellets having both curved and flat surfaces and a maximum dimension of from about 0.5 to 5 centimeters. The grinding occurs in the presence of a fluid, preferably a liquid, for a sufficient time and at a sufficient vibrational energy to obtain said milled powder having such smaller average particle size. At least 90% of the pellets in the silicon carbide media have a specific gravity (density) greater than 3.05 g/cm$^3$.

The invention includes the unique media, which may be used for various grinding operations, and includes unique milled powders. One of the unique powders has particles which have an average length to width ratio of greater than 2.5. Another of the unique powders is black silicon carbide containing from 200 to 2,000 parts per million of aluminum in solid solution.

20 Claims, 2 Drawing Figures

VIBRATORY GRINDING OF SILICON CARBIDE

BACKGROUND OF THE INVENTION

(A) FIELD OF THE INVENTION

This invention relates to grinding methods and particularly relates to grinding of ceramic materials to ceramic powders. The invention especially relates to vibratory grinding of silicon carbide.

(B) HISTORY OF THE PRIOR ART

In the prior art there has been a need for silicon carbide, and other hard refractory carbides such as boron carbide, in powdered form wherein the average particle size of the powder is very small, i.e., less than about 5 microns, preferably less than 2 microns, and most preferably less than 1 micron. Such refractory carbide powders are especially required for sintering operations wherein the powders are sintered into refractory carbide articles. In the prior art, especially for silicon carbide and boron carbide which have a hardness of over 9 on the Mohs scale, it was exceedingly difficult to obtain powders having a particle size as small as desired. Furthermore it was impractical, without time consuming and expensive operation techniques, to obtain such powders where the average largest dimension (particle size) of the particles in the powders is less than 1 micron. Such powders have been obtained by sedimentation of fines from common crushing or milling operations, e.g. pure silicon carbide powder. Such methods are very inefficient, e.g. less than 1%, for the purpose of obtaining powders having average particle sizes below 1 micron. Furthermore, the grains of such powders have a generally blocky structure, e.g. an average length to width ratio of less than 2.5. Such blocky structures are believed, in accordance with the present invention and contrary to prior beliefs, to have a detrimental affect upon packing efficiency of such powders into desired shapes.

In addition, it was thought that pure silicon carbide should be used to make sinterable powders, e.g. solid solution aluminum usually less than 100 ppm and in any case less than 200 ppm. Such pure powders required costly pure starting materials which are not readily available throughout the world, e.g. pure quartz sand.

Vibratory mills in general are known in the art and, for example, are described in U.S. Pat. No. 3,268,177.

It is disclosed in SWECO, Inc. Bulletin GM781A April 1978 that alumina or zirconia cylinders could be used as media in a vibratory mill to reduce the particle size of powder. Such media is not, however, generally suitable for reducing the particle size of abrasive materials such as silicon and boron carbides due to contamination by particles from the media. Furthermore, alumina is very undesirable when the silicon carbide powder is to be used in sintering operations and cannot be easily removed from the powder. In addition, alumina is relatively dense, i.e. a specific gravity of 3.9, which requires substantial energy to vibrate alumina media.

To avoid contamination by media, it was proposed, e.g., in U.S. Pat. No. 4,275,026, to grind materials such as titanium diboride in a mill having surfaces and grinding media constructed of a noncontaminating material such as titanium diboride itself.

Use of silicon carbide as the grinding media in a vibratory mill was attempted by the inventors herein to make pure silicon carbide powders having an average particle size over 1 micron to make commercial sintered products. This method and the resulting powder were not, however, entirely satisfactory since the media had an undesirable wear rate. In addition, the silicon carbide particles resulting from media wear were exceedingly undesirable because the ultrafine powder produced and mixed with the larger particles was actually too small, e.g. an average particle size of about 0.02 microns. Even a few percent, e.g. over 5% of these fine particles have an undesirably high percentage of oxygen which unless removed by further processing, interferes with certain operations such as sintering. Even a few percent, e.g. over 5%, of such a small amount of these particles also interfere with the pressing operations used to shape an article prior to sintering. Additionally, silicon carbide media is costly and difficult to manufacture; therefore, wear of the media should be kept to a minimum.

With the exception of properties unique to silicon carbide, it is to be understood that the invention discussed herein similarly applies to other hard refractory carbides such as boron carbide.

BRIEF DESCRIPTION OF THE INVENTION

In accordance with the present invention there is therefore provided a method for reducing the particle size of an initial silicon carbide powder to a milled powder having an average particle size of below 1 micron but greater than an average of about 0.2 micron, without grinding media contamination. The method comprises milling the larger particles in a vibratory mill in the presence of sintered silicon carbide media comprising silicon carbide pellets having flat, curved or both flat and curved surfaces and a maximum dimension of from about 0.5 to 5 centimeters. It has been found that at least some flat surface is desirable. The grinding occurs in the presence of a fluid, preferably a liquid, for a sufficient time and at a sufficient vibrational energy to obtain said milled powder having such smaller average particle size. At least 90% of the pellets in the silicon carbide media have a specific gravity (density) greater than 3.05 g/cm$^3$.

The invention includes the unique media, which may be used for various grinding operations, and includes unique milled powders. The milled powders are milled carbide powders wherein the average particle size is less than 1 micron, less than 7 numerical percent of the powder particles have a particle size smaller than 0.04 microns and greater than 95% of the particles have a particle size less than 6 microns. One of the unique carbide powders has particles which have an average length to width ratio of greater than 2.5. Another of the unique powders is black silicon carbide containing from 200 to 2,000 parts per million of aluminum in solid solution.

DETAILED DESCRIPTION OF THE INVENTION

Figure 1:
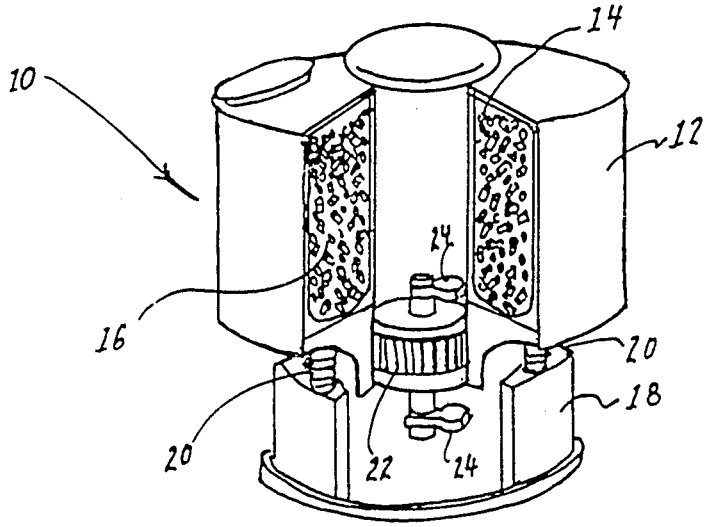
FIG. 1 is a front perspective view in cross section of a vibratory mill used in accordance with the present invention.
Figure 2:
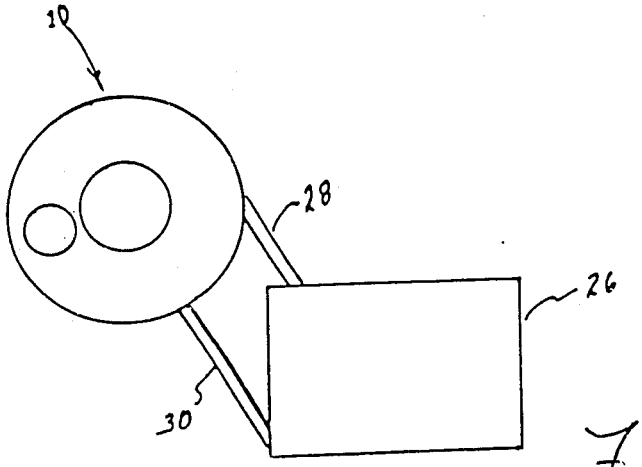
FIG. 2 is a top plan view of a vibratory mill connected with a heat exchanger.

In accordance with the present invention a special grinding media must be used to obtain silicon carbide powder having an average particle size as small as desired, i.e., less than 1 micron, with less than 7 and preferably less than 5 weight percent media wear product in the powder. "Average particle size" as used herein means the average of the greatest particle dimension of all particles. The media comprises sintered silicon carbide pellets which may be of essentially any shape. The media may have flat, curved or both flat and curved surfaces. In general, sharp edges are not desirable because of a tendency for sharp edges to crack. Similarly, all curved surfaces are not desirable because only point to point grinding can be obtained thus reducing grinding efficiency. The shape of the media should, however, be selected to avoid tight packing of the media. Tight packing reduces the space within which powder can be ground and in addition may cause the media pellets to move in concert rather than independently.

The maximum dimension of the media is usually from about 0.5 to 3 centimeters. The ratio of the maximum dimension of each of the pellets to the minimum dimension is usually between 1:1 and about 3:1. The pellets are preferably cylindrical in shape wherein the diameter of the cylinder is from 0.3 to 3 and preferably from 0.75 to 1.25 times the length of the cylinder. The diameter of the cylinder is usually between 0.8 and 1.5 centimeters. At least 90% and preferably at least 95% of the pellets have a density greater than 3.05 g/cm$^3$, preferably greater than 3.10 g/cm$^3$, and most preferably as high as 3.15 g/cm$^3$. It has been unexpectedly found that densities at this level, when tested in a ball mill, have a wear rate which is almost 50 times less than media having a density of only about 0.20 g/cm$^3$ less. In vibratory mills, used in accordance with the present invention, the higher density media has about one-third the wear of the lower density media or less.

Even at the theoretical densities of silicon carbide of 3.21 g/cm$^3$, silicon carbide is about 18% less dense than the theoretical density of alumina. It therefore takes less energy to operate a vibratory mill using silicon carbide media in accordance with the present invention.

The pellets are preferably made by pressureless sintering by techniques known to those skilled in the art, such as, for example, as disclosed in U.S. Pat. No. 4,123,286. The starting sintering powder must, however, be a high quality powder. In general, silicon carbide powder having an average particle size of from about 0.2 to about 1 micron is blended with from about 4 to about 8% by weight of the silicon carbide, of an organic binding agent such as resole phenolic resin or polyvinyl alcohol or mixtures therof. Small percentages of sintering aids, e.g. about 0.5% boron carbide, and carbon resulting from the binding agent, known to those skilled in the art may be present. In general greater than 1% silica is highly undesirable. Silicon and oxides are similarly undesirable. Large quantities of metals, except as disclosed herein, are also generally undesirable.

The blend is then formed into pellets under high pressure, e.g. 10,000 to 20,000 psi. The pellets are then heated to cure the binder and pressureless sintered at from about 2000° to about 230020 C. and preferably from 2100° to 2250° C. for from about 15 to about 45 minutes.

The resulting media has unexpectedly good resistance to degradation during grinding of silicon carbide powders by vibration. In addition, such silicon carbide media can be used to grind silicon carbide without media contamination. "Contamination" used in this context means chemical contamination, e.g. contamination with iron or another substance from the media other than silicon carbide.

The grinding operations usually take place using a fluid to suspend the silicon carbide powders during grinding. The fluid may be a gas, such as air or a liquid, such as water. Other liquids such as hexane may be used. The preferred fluid is water. The suspension, e.g. an aqueous slurry, can contain from 30–60% but preferably contains from 40–55% weight percent silicon carbide powder.

The initial average particle size of the silicon carbide powder usually ranges from about 15 to about 150 microns, and typically about 20 to about 40 microns.

The starting material may be made by known crushing or grinding methods. If iron contamination results from crushing or milling to obtain starting material, it may be removed magnetically or by acidification or both.

The grinding operation takes place in a vibratory mill wherein the media is vibrated at from about 750 to about 1,800 cycles per minute, preferably at about 1,000 to 1,300 cycles per minute in the presence of the silicon carbide and suspending fluid. Vibration is at least two dimensional and desirably three dimensional. At least one vector of the vibration should be in the vertical direction. The amplitude of the vibration is usually between 0.40 and 1.0 cm. Examples of suitable vibratory mills are those manufactured by SWECO, Inc., Los Angeles, Calif., U.S.A. In general, such mills comprise a drum which is vibrated by out-of-balance weights turned by a motor. To reduce an initial silicon carbide powder having an average particle size of from about 15 to about 40 microns to a powder in accordance with the present invention, a milling time of from about 15 to about 50 hours is usually required. When the initial powder has an average particle size below about 15 microns, grinding times of from about 2 to about 20 hours are usually required. Longer grinding times result in the development of smaller average particle sizes.

A specific type of such a vibratory mill may be described by reference to the drawings which shows a grinding apparatus 10, comprising a drum 12 having an annular chamber 14 containing grinding media 16. Drum 12 is supported by a base 18 by means of springs 20. Drum 12 is attached to motor 22 which causes a vibration due to eccentric weights 24. Due to increases in temperature during milling of silicon carbide a cooling system of some sort is required for extended milling time. In the absence of a heat exchanger when grinding silicon carbide, an aqueous slurry could actually boil. Undesirable oxidation can then increase and the bubbles can interfere with grinding. In accordance with the present invention, the slurry being ground is circulated through a heat exchanger 26 by means of pipes 28 and 30 to reduce the temperature.

The finished milled powder in accordance with the present invention has an average particle size less than 1 micron but usually greater than 0.2 micron.

The silicon carbide milled powder contains less than 7 numerical percent of powder particles having a particle size smaller than 0.04 microns and preferably less than 5 numerical percent having a particle size less than 0.03 microns. Greater than 95%, and preferably greater than 97%, of the particles have a particle size less than 6 microns. Usually more than 84 numerical percent of the particles have a particle size less than 3.5 microns.

One of the unique characteristics of powders prepared in accordance with the present invention is that the particles of the powder usually have an average length to width ratio of greater than 2.5. It is believed that powders having such an elongated shape have a better packing efficiency when packed under pressure to form a sinterable shape. "Packing efficiency" means the percentage of available space occupied by silicon carbide in the packed article. When more available space is occupied, the density is higher. When all available space is occupied by silicon carbide, the density of the article is the theoretical density of silicon carbide which is 3.21 g/cm$^3$. The density of the pressed and unintered article is called the "green density." The shape of particles in accordance with the present invention are therefore believed to result in higher and more consistent green densities which in turn result in a more consistent sintered product. It is not, however, believed that a length to width ratio of greater than 5.0 would be desirable.

Additionally, it has been found that a black silicon carbide powder can be prepared by the method of the present invention which is highly suited to sintering operations. The black powder contains aluminum in an amount between 200 and 2,000 but preferably between 400 and 1,500 parts per million. In these quantities the aluminum is usually in solid solution. Free undissolved aluminum or aluminum salts or oxides are generally not desirable. The presence of solid state dissolved aluminum contributes to a silicon carbide structure which is more fracture resistant.

Powders having any silicon carbide crystalline form may be prepared in accordance with the present invention. For sinterable silicon carbide powders, alpha silicon carbide is especially desirable. Usually the better of such powders contain at least 50 weight percent alpha silicon carbide. Such sinterable powders are readily obtainable in accordance with the method of the invention without additional treatment to remove impurities added by the media in the vibratory grinding operation. If desired freed carbon may be removed by flotation, iron may be removed by acidification and silica may be removed by HF treatment.

EXAMPLES

Example I

Silicon carbide is produced on a commercial scale by the well-known Acheson process (U.S. Pat. No. 492,767) in an electric resistance furnace. A trough-like furnace is filled with a mixture of high grade silica and coke, forming a long bed having an oval cross section. On each end of the furnace is an electrode and power is applied to a graphite core in the center of the charge. As the SIC forms, the conductivity of the charge increases and power is adjusted by lowering the voltage. The core heats up to about 2600° C. and then the termperature falls to a fairly constant value of 2040° C. The outer edges of the furnace mix remain at about 1370° C. because of the burning gases at the surface. When the heating cycle is completed, the furnace is cooled for several days. The side walls are then removed, the loose, unreacted mix taken away, and the remaining silicon carbide cylinder is raked to remove the crust, about 4 cm thick. This crust contains 30 to 50% SiC as well as some condensed metals and oxides. The cylinder is then transported in sections to a cleaning room, where a further partially reacted layer (about 70% SiC) is chipped away, and the central graphite is recovered for reuse. The remaining cylinder constitutes highgrade silicon carbide.

The overall reaction is: $SiO_2+3\ C \rightarrow SiC+2\ CO$. Sawdust may be added to increase the porosity of the mix, thus increasing the circulation of reacting gases and facilitating the removal of CO. Lack of porosity may create blowouts, causing inferior cylinder. A small amount of aluminum is present to enhance SiC grain toughness, electrical properties and black color.

Silicon carbide prepared by this prior art method is crushed and milled in a ball mill. To meet further sinterable powder processing requirements, the resulting ball milled powder should usually meet the specifications in Table 1.

TABLE 1

| Property | Units | Limits |
|---|---|---|
| Particle Size | +200 mesh | 5% max. |
| | −325 mesh | 80% min. |
| Total SiC | weight % | ≧95% |
| Total Fe | weight % | ≦2.0% |
| Aluminum | weight % | ≦0.2% |
| Free carbon | weight % | ≦1.0% |
| Free $SiO_2$ | weight % | ≦1.4% |
| Oxygen | weight % | ≦1.0% |

The powder is further treated magnetically to remove free iron and acidified to remove additional iron and oxygen and to remove carbon by flotation. Excess $SiO_2$ can be removed by treatment with HF.

The powder is sedimented to obtain a submicron fraction or is further treated by vibrational grinding in accordance with the present invention to reduce the average particle size to below 1 micron. The finished sinterable powder should desirably contain less than 1% $SiO_2$, less than 0.5% $O_2$, less than 0.02% iron, and less than 0.5% free carbon.

The resulting submicron powder is sintered in accordance with the teachings of U.S. Pat. No. 4,123,286 to produce cylindrical grinding media. In particular, about 50 parts of submicron silicon carbide are blended with about 50 parts of submicron silicon carbide are blended with about 0.25 part by weight of $B_4C$ sintering aid, about 0.6 part by weight of deflocculant, about 5.5 part by weight of binders and plasticizers, and about 43 parts by weight of water. In making the blend, care is taken to avoid lumps and agglomeration. The mixture is then spray dried to obtain the sinterable powder.

Media for use in accordance with the present invention is made by pressing cylinders from the sinterable powder as previously described to form cylinders having a height of 0.590 inch and a diameter of 0.630 inch. The cylinders are formed at a pressure of about 16,000 psi.

The cylinders are then sintered at about 2100° for about 30 minutes. The resulting cylindrical media has a fired density of 3.11 g/cm$^3$ minimum (97% of the 3.21 g/cm$^3$ theoretical density of silicon carbide). Media of lower density will result if the powder is of inappropriate size or if undesirable impurities are present.

Sintering of powders made by the vibratory grinding process of the present invention may similarly be accomplished to manufacture other sintered silicon carbide shapes.

EXAMPLE II

A five gallon ball mill filled with media as prepared in Example I, except that the densities were lower. 6,000 ml of water was added. The mill was then operated for 24 hours. Two runs were made. One of the runs used media having a density of 2.8 to 2.9 g/cm$^3$ and the other run used media having a density of 3.0 to 3.1 g/cm³. The results are shown in Table 2.

TABLE 2

| Media Density (g/cm³) | Weight of Media (g) | Wear in 24 hours (g) | (%) |
|---|---|---|---|
| 2.8–2.9 | 9094 | 195 | 2.1 |
| 3.0–3.1 | 9072 | 4 | 0.04 |

This example shows an unexpected 50 fold decrease in media wear with only a 0.2 g/cm³ (7%) increase in media density.

EXAMPLE III

About 14,000 pounds of media as prepared in Example I, over 90% of which had a density of 3.1 g/cm³ or greater, was introduced into a 182 gallon urethane lined vibratory SWECO mill as shown in the drawing. 1,200 pounds of silicon carbide powder feed material slurried in water with a deflocculant is introduced into the mill. The feed material is prepared by crushing and ball milling silicon carbide as discussed in Example I. After ball milling, the powder is treated by magnetic separation to remove most metal wear products and by flotation to reduce carbon content. The powder is then passed through a 200 mesh screen to obtain a product having an average particle size less than 40 microns.

After addition of the feed material slurry, the vibratory mill is vibrated at about 1,150 cycles per minute for 35 hours. The resulting powder is found to have an average particle size of 0.85 microns, and an average length to width ratio of 2.56. Less than 5 numerical percent of the powder particles are found to be smaller than 0.04 microns. Greater than 97 numerical percent of the particles have a particle size less than 6 microns and greater than 84 numerical percent have a particle size less than 3.5 microns. Average particle sizes, size ranges and particle widths, are determined by statistical analysis of SEM micrographs of samples. Specifically, a small powder sample is ultrasonically dispersed in methanol. A drop of the dispersion is placed on a polished aluminum substrate and is gold coated. Quantitative image analysis is performed on the sample with a LeMont DA-10 Image Analysis System interfaced with a Cam-Scan SEM. The analysis was performed at a magnification of 5000X. More than five hundred particles were sized for each sample by the LeMont algorithm "Gridameter."

What is claimed is:

1. A grinding mixture comprising silicon carbide pellets and a suspension of silicon carbide powder, having a particle size of less than 150 microns, in a fluid, said silicon carbide pellets having a maximum dimension of from about 0.5 to 5 centimeters, at least 90 percent of the pellets having a density greater than 3.05 g/cm³.

2. The mixture of claim 1 wherein the pellets have both flat and curved surfaces.

3. The mixture of claim 2 wherein the pellets have a cylindrical shape and the diameter of the cylinder is from 0.3 to 3 times the length of the cylinder and the density of at least 90 percent of the pellets is greater than 3.10 g/cm³.

4. The mixture of claim 3 wherein the diameter of the cylinder is between 0.8 and 1.5 centimeters and the diameter is from 0.75 to 1.25 times the length of the cylinder.

5. A method for reducing the particle size of silicon carbide powder to an average particle size of from about 0.2 to less than 1 micron, said method comprising milling the powder while suspended in a fluid in a vibratory mill in the presence of silicon carbide pellets grinding media for a sufficient time and at a sufficient vibrational energy to obtain milled silicon carbide powder having an average particle size of from about 0.2 to less than 1 micron; said silicon carbide pellets having a maximum dimension of from about 0.5 to 5 centimeters, at least 90 percent of the pellets having a density greater than 3.05 g/cm³.

6. The method of claim 5 wherein the fluid is water and the pellets have both flat and curved surfaces.

7. The method of claim 6 wherein the pellets have a cylindrical shape and the diameter is from 0.3 to 3 times the length of the cylinder and the density of at least 90 percent of the pellets is greater than 3.10 g/cm³.

8. The method of claim 6 wherein the vibratory mill is vibrated at from about 750 to about 1,800 cycles per minute.

9. The method of claim 6 wherein the vibratory mill is vibrated at from about 1,000 to about 1,300 cycles per minute.

10. The method of claim 6 wherein the initial powder has an average particle size of from about 15 to about 40 microns and the milling time is from about 15 to about 50 hours.

11. The method of claim 6 wherein the initial powder has an average particle size of less than 15 microns and the milling time is from about 2 to about 20 hours.

12. The method of claim 6 wherein finished milled powder contains less than 5% by weight silicon carbide resulting from media wear.

13. The method of claim 6 wherein the media wears at a rate of less than 0.5 percent per 24 hours of operation in the absence of feed powder in a ball mill.

14. The mixture of claim 3 wherein the pellets wear at a rate of less than 0.5 percent per 24 hours of operation in the absence of silicon carbide powder in a ball mill.

15. The method of claim 6 wherein the fluid is water forming a slurry of silicon carbide and the slurry is circulated through a heat exchanger to reduce its temperature.

16. A silicon carbide milled powder wherein the average particle size is less than 1 micron, less than 7 numerical percent of the powder particles having a particle size smaller than 0.04 microns and greater than 95 numerical percent of the particles have a particle size less than 6 microns, said silicon carbide containing between 200 and 2,000 ppm of aluminum in solid solution.

17. The silicon carbide milled powder of claim 16 wherein the silicon carbide comprises at least 50 weight percent alpha silicon carbide.

18. The silicon carbide milled powder of claim 16 wherein greater than 97 numerical percent of the particles have a particle size less than 6 microns and greater than 84 numerical percent of the particles have a particle size less than 3.5 microns.

19. The powder of claim 16 wherein the silicon carbide contains between 400 and 1500 ppm aluminum in solid solution.

20. The powder of claim 16 wherein the powder particles have an average length to width ratio of greater than 2.5.

* * * * *